US006442962B1

(12) United States Patent
Gaetke et al.

(10) Patent No.: US 6,442,962 B1
(45) Date of Patent: Sep. 3, 2002

(54) PORTABLE SALAD BAR

(76) Inventors: Margaret Gaetke, 379 Sims Ave., St. Paul, MN (US) 55101; Terry Gaetke, 379 Sims Ave., St. Paul, MN (US) 55101

( * ) Notice: Subject to any disclaimer, the term of this patent is extended or adjusted under 35 U.S.C. 154(b) by 0 days.

(21) Appl. No.: 09/503,613

(22) Filed: Feb. 11, 2000

(51) Int. Cl.[7] ..... F25D 3/08

(52) U.S. Cl. ..... 62/457.6; 62/459

(58) Field of Search ..... 62/457.6, 457.7, 62/459, 463; 206/522

(56) References Cited

U.S. PATENT DOCUMENTS

| | | | | | |
|---|---|---|---|---|---|
| 3,641,785 | A | * | 2/1972 | Portz | 62/396 |
| 4,375,758 | A | | 3/1983 | Simmons | |
| 4,574,594 | A | | 3/1986 | Simmons et al. | |
| 4,612,781 | A | | 9/1986 | Swerdon | |
| 4,679,242 | A | * | 7/1987 | Brockhaus | 206/522 |
| 4,777,992 | A | | 10/1988 | Olger | |
| 4,809,352 | A | | 2/1989 | Walker | |
| 4,852,741 | A | | 8/1989 | Van Benschoten | |
| 5,005,702 | A | | 4/1991 | Davis et al. | |
| 5,134,930 | A | | 8/1992 | Mei-Hwa | |
| 5,671,846 | A | | 9/1997 | Frank | |
| 5,727,857 | A | | 3/1998 | Smith | |
| 5,829,627 | A | | 11/1998 | Martindale | |
| 5,845,515 | A | * | 12/1998 | Nelson | 62/457.7 |
| 6,123,217 | A | * | 9/2000 | Miller | 220/592.19 |

* cited by examiner

*Primary Examiner*—William E. Topolcai
*Assistant Examiner*—Mohammad M. Ali
(74) *Attorney, Agent, or Firm*—Merchant & Gould P.C.

(57) ABSTRACT

One aspect of the present invention is directed toward a portable salad bar having a flexible base. Further, one or more inflatable chambers are connected to the base, and the inflatable chambers extend around the base to form a reservoir having a flexible bottom surface defined by the base. The inflatable chambers can then be deflated and the portable salad bar can be folded for facilitating transportation and storage. Another aspect of the present invention is directed toward a portable salad bar having a flexible base with a non-inflatable generally planar surface. One or more inflatable chambers are connected to the base, wherein the inflatable chambers extend upwardly and have an inner wall and an outer wall. Further, the inner wall and the base define a reservoir that has a flexible bottom surface. A drain extends through the inflatable chambers and a filter screen covers the drain. A valve is engaged with the inflatable chambers, and the inflatable chambers can be inflated and deflated by way of the valve. A further aspect of the present invention is directed toward a portable salad bar having a flexible planar surface with a peripheral edge. One or more inflatable chambers extend around the peripheral edge and are secured to the planar surface. The inflatable chambers and the planar surface form a reservoir that has a flexible bottom surface. A drain is connected to the reservoir, and a valve is engaged with the inflatable chambers. Further, the actuation of the valve deflates the inflatable chambers.

6 Claims, 2 Drawing Sheets

PORTABLE SALAD BAR

FIELD OF THE INVENTION

This invention relates generally to a portable salad bar. More specifically, this invention relates to a portable salad bar including a base and inflatable chambers that form a reservoir and is constructed to be folded into a compact storage configuration.

BACKGROUND OF THE INVENTION

In the food industry, keeping food products fresh and edible is a top priority. One of the most crucial factors in maintaining freshness is temperature control. When food products are permitted to warm excessively, the food product's flavor and texture can be adversely affected. Further, the food products can ultimately spoil.

Many refrigeration techniques are known to those skilled in the art. The simplest refrigeration technique is to keep food products on ice. Mechanical refrigeration systems also are frequently utilized to control food product temperatures. The determination of the proper refrigeration techniques depends on the type of food being refrigerated and the nature of the refrigeration installation. Meat freezers, for example, require long-term low temperature refrigeration while salad bars require temporary and low to moderate temperature refrigeration.

With increasing awareness of healthfulness and nutrition, salad bars have become increasingly popular in recent years. Restaurants frequently feature a permanent salad bar designed to keep food ingredients fresh. Permanent salad bars generally use ice or mechanical refrigeration to maintain the food ingredients at cool temperatures. Restaurant salad bars are typically heavy and bulky. Further, permanent salad bars are generally affixed to a building structure, and therefore are cumbersome and inefficient to transport.

While refrigerated salad bars are commonplace in restaurants, salad bars in temporary installations frequently lack any form of refrigeration. When a salad bar is prepared in a home, for instance, food ingredients are often presented in individual containers on a table or counter. The food ingredients may be refrigerated prior to use, but the food ingredients are frequently presented without refrigeration and therefore are apt to spoilage.

In temporary installations, such as picnics or parties in the home, a refrigerated salad bar is needed to keep food products fresh by way of ice or a similar cooling source. In these situations, however, a permanent fixture is usually both unnecessary and undesirable. When intended for a single or infrequent use, conventional salad bars are disadvantageous because they are cumbersome to transport and inconvenient to store after use.

Catering services also frequently use salad bars to present food items. Catering services often use ice-cooled salad bars having a solid structure. Because of the solid support structure, these salad bars can also be cumbersome to transport and store.

Accordingly, a need exists for a portable salad bar that provides a structural reservoir for keeping food products fresh on ice or a similar cooling source, and further provides for reconfiguration into a compact and lightweight form for convenient transport and storage.

SUMMARY OF THE INVENTION

In accordance with the invention, the above and other desires and needs are met by providing a portable salad bar.

One aspect of the present invention provides an apparatus having a reservoir formed from one or more inflatable chambers that deflate to permit the portable salad bar to be folded into a compact storage configuration.

One aspect of the present invention is a portable salad bar having a flexible base. Further, one or more inflatable chambers are connected to the base, and the inflatable chambers extend around the base to form a reservoir having a flexible bottom surface defined by the base. The inflatable chambers can then be deflated and the portable salad bar can be folded for facilitating transportation and storage.

Another aspect of the present invention is a portable salad bar having a flexible base with a non-inflatable generally planar surface. One or more inflatable chambers are connected to the base, wherein the inflatable chambers extend upwardly and have an inner wall and an outer wall. Further, the inner wall and the base define a reservoir that has a flexible bottom surface. A drain extends through the inflatable chambers and a filter screen covers the drain. A valve is engaged with the inflatable chambers, and the inflatable chambers can be inflated and deflated by way of the valve.

A further aspect of the present invention is a portable salad bar having a flexible planar surface with a peripheral edge. One or more inflatable chambers extend around the peripheral edge and are secured to the planar surface. The inflatable chambers and the planar surface form a reservoir that has a flexible bottom surface. A drain is connected to the reservoir, and a valve is engaged with the inflatable chambers. Further, the actuation of the valve deflates the inflatable chambers.

In sum, the invention represents a significant improvement over the prior art in many ways. The portable salad bar in accordance with the invention provides a structural reservoir for keeping food products fresh on ice or a similar cooling source. Further, the portable salad bar in accordance with the present invention provides for reconfiguration of the portable salad bar into a compact and lightweight form for convenient transport and storage. These and various other features and advantages, which characterize the present invention, will be apparent from a reading of the following detailed description and review of the associated drawings.

BRIEF DESCRIPTION OF THE DRAWINGS

The organization and manner of the structure and operation of the invention, and advantages thereof, may best be understood by reference to the following description, taken in connection with the accompanying drawings, wherein like reference numerals identify like elements throughout the views, in which.

DETAILED DESCRIPTION OF THE PREFERRED EMBODIMENTS

Preferred embodiments of the present invention will be described in detail with reference to the drawings.

Figure 1:
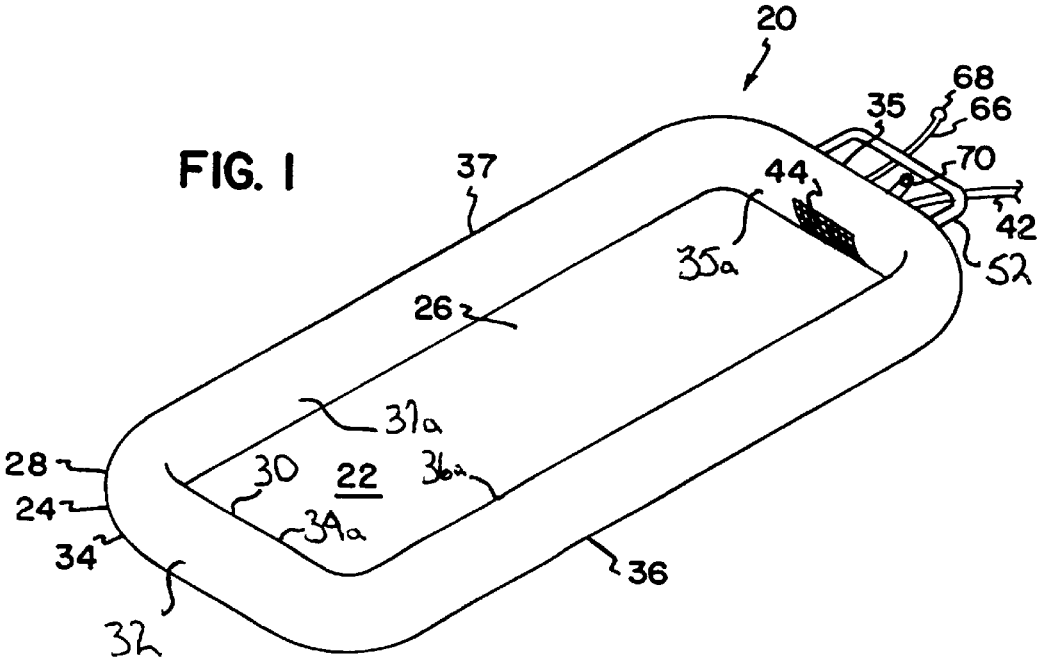
FIG. 1 is a perspective view of one embodiment of a portable salad bar of the present invention.
Figure 2:
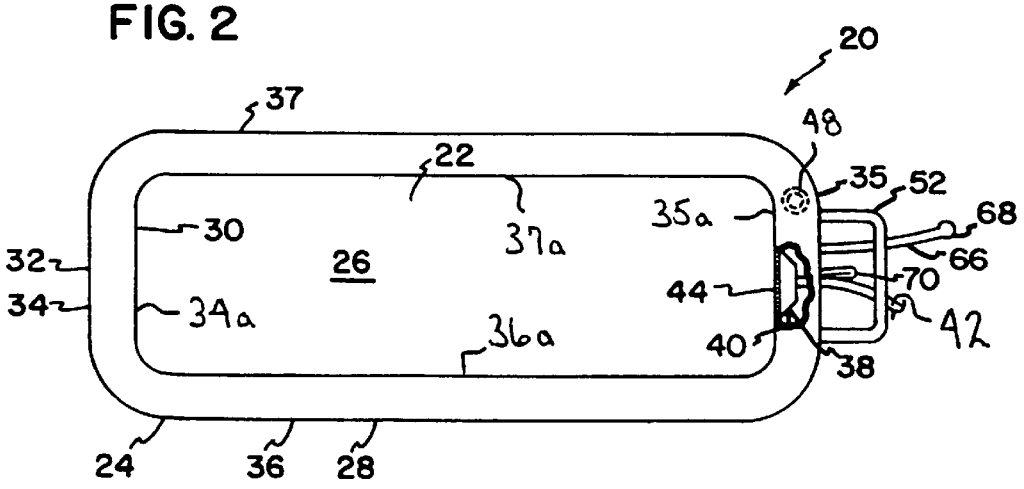
FIG. 2 is a top view of the portable salad bar of FIG. 1 with a cutaway portion showing the drain.

In general terms, referring to FIGS. 1 and 2, one embodiment of the invention is directed to a portable salad bar 20 with an inflatable chamber 24 that forms a reservoir 26 for holding a bed of ice or a similar cooling source. The inflatable chamber 24 has a valve 48 that can be actuated to deflate the inflatable chamber 24. When the inflatable chamber 24 is deflated, the portable salad bar 20 can be reconfigured into a compact form for transport and storage. Reconfiguration is achieved by way of folding, rolling or other applicable methods.

The present invention has many advantages. The portable salad bar 20 is particularly adapted for commercial catering or household use. Because it deflates to a lightweight and compact configuration, the portable salad bar 20 may be easily carried by a single person and efficiently stored away between uses. When the portable salad bar 20 is needed for use, it may be quickly reconfigured, without assembly, by unfolding the structure and applying air pressure to the valve 48. Further, in an alternative embodiment, a self-inflatable structure may be utilized for inflating an inflatable chamber 24, which is well known to those skilled in the art.

FIGS. 1 and 2 illustrate the portable salad bar 20, identified generally as 20, in one possible embodiment of the invention. The portable salad bar 20 has a flexible base 22 and an inflatable chamber 24 connected to the base 22. The base 22 is generally a non-inflatable planar surface. The portable salad bar 20 can have one or more inflatable chambers 24 that extend around the base 22. The base 22 and inflatable chamber 24 together define a reservoir 26. The reservoir 26 is adapted and configured to contain a volume of ice and portions of food ingredients. By suspending the food ingredients in a bed of ice or a similar cooling source, the salad bar 20 maintains the food ingredients at a low to moderate temperature.

The base 22 is formed from a matrix of sheet material 28. The base 22 may be formed from a flexible sheet material to facilitate folding. Alternatively, the base 22 may be formed from a rigid sheet material having fold lines to permit reconfiguration for transport and storage. The base 22 may be formed from a thermal insulating material to isolate the ice bed from conductive heating due to an underlying supporting surface. The base 22 may also be advantageously formed from the same material as the inflatable chamber 24 to facilitate sealed bonding of the base 22 and sheet material. For example, the base 22 may be manufactured from a number of materials, including but not limited to plastics, for example, polyvinyl chloride, polyurethane, foam rubber or other similar plastic materials.

The inflatable chamber 24 is formed from resiliently compressible sections of a gas impervious sheet material. A heat sealing process, adhesives, or other similar connection processes may join the sections. Further, the sheet material may be fabricated from a number of materials, including but not limited to, single or multi-ply plastics, vinyl or vinyl reinforced fabric.

Referring to FIG. 2, the inflatable chamber 24 has an inner wall 30 and an outer wall 32. The inner wall 30 faces the reservoir 26. In one embodiment, shown in FIG. 1, the inflatable chamber 24 has a generally circular cross section. In another embodiment, the inflatable chamber 24 has a rectangular cross section.

The reservoir 26 may also have a variety of shapes. As shown in FIGS. 1 and 2, the inflatable chamber 24 has a first short wall portion 34 and a second short wall portion 35, the second short wall portion including the valve 48 for adding or withdrawing a gas, such as air. Further, the inflatable chamber 24 has a first long wall portion 36 and a second long wall portion 37. In one embodiment, the reservoir 26 has a rectangular shape, and the inner wall 30 has short wall portions 34*a,* 35*a* and long wall portions 36*a,* 37*a*.

Further, referring to FIG. 2, a drain 38 connects to the reservoir 26. The drain 38 permits water or other fluid from melted ice or a similar cooling source to flow away from the portable salad bar 20 to a remote drainage location. In one embodiment, the drain 38 extends through the inflatable chamber 24 to direct fluid away from the reservoir 26. As shown in FIG. 2, the drain has a tapered drain entrance 40 leading to a drainage tube 42. A filter screen 44, shown in FIG. 1, covers the drain 38. The filter screen 44 prevents contaminants, such as spilled food ingredients, from entering the drain and potentially clogging the drainage tube 42.

Figure 3:
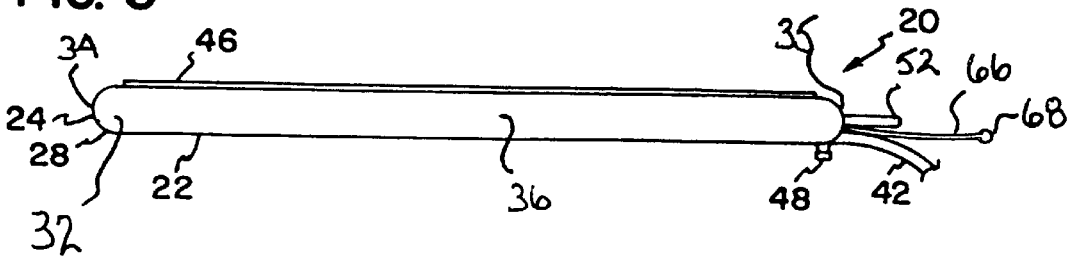
FIG. 3 is a side view of the portable salad bar of FIG. 1 showing a cover, valve and drainage tube.
Figure 4:
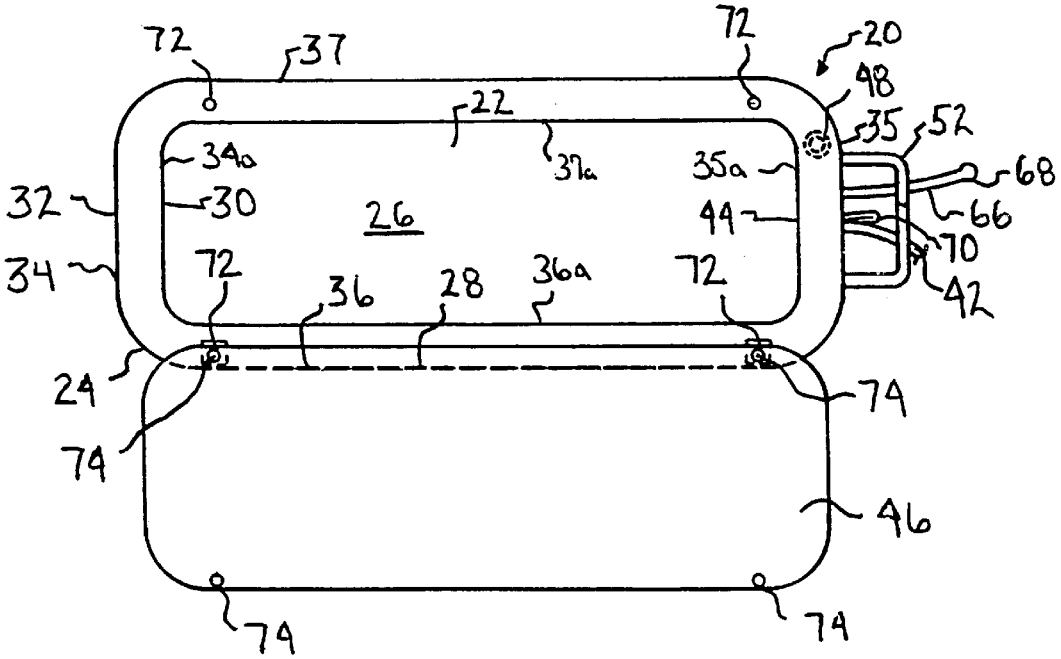
FIG. 4 is a top view of the portable salad bar of FIG. 1 showing the cover.

Referring to FIGS. 3 and 4, the portable salad bar 20 has a cover 46. In one embodiment, the cover 46 fits over the inflatable chamber 24. In one embodiment, the cover 46 is connected to the inflatable chamber 24 by way of a male snap 72 and a female snap 74 interconnection, or other similar interconnection systems known to those skilled in the art. The cover 46 aids the refrigeration process by restricting convective heat transfer and by shielding the food ingredients from sunlight or other sources of heat. A gas, such as air, which is trapped in the reservoir acts as an insulating medium to further support the refrigeration process. The cover 46 also protects the food ingredients by shielding it from whether conditions, for example, rain and dust, and from insects or other contaminants.

Figure 5:
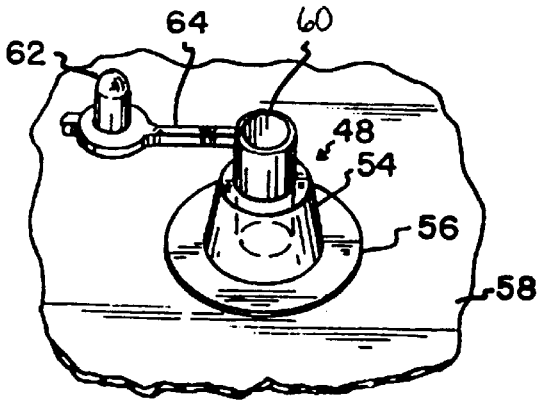
FIG. 5 is a perspective view of the valve structure of the portable salad bar of FIG. 1.

Referring to FIG. 5, a valve 48 is engaged with the inflatable chamber 24. The valve 48 fluidly connects the inside of the inflatable chamber 24 with the exterior to allow a gas to be selectively added or withdrawn.

The valve 48 is of a well known construction to those skilled in the art, including a base 54 with a flange 56 that is sealed to a wall portion 58 of the inflatable chamber 24 by way of a heat sealing process, adhesives or other similar connection processes. A stem 60 extends through the base 54 to the interior of the inflatable chamber 24. A valve stem-closing member 62 connects with a strap 64 integral with the stem 60 or base 54. The valve 48 may be constructed to allow recess into the surface of the inflatable chamber 24 when not in use. The valve 48 is shown in an open condition in FIG. 5 and in a closed condition in FIG. 3.

The portable salad bar 20 has an inflated serving configuration and a deflated storage configuration. By actuating the valve 48, the inflatable chamber 24 may be inflated or deflated. Inflation of the chamber may be accomplished by way of a pump, air compressor, human, or other inflation sources know to those skilled in the art.

Deflation of the inflatable chamber 24 permits the portable salad bar 20 to be flattened and folded into a compact form for easy transportation and storage. Deflation of the chamber may be accomplished by an automated or manual folding or rolling of the inflatable salad bar 20, or other sources of deflation known to those skilled in the art. In the deflated storage configuration, the portable salad bar 20 takes up minimal space compared to the inflated configuration.

The compactness of the storage configuration facilitates carrying, transportation and storage. The portable salad bar 20 also has the advantage of being lightweight due to the inflatable chamber 24 structure. As a result, a single person can carry the portable salad bar 20. The portable salad bar 20 can be, for instance, inserted into a carrying sack for easy transport.

As shown in FIGS. 1–4, the portable salad bar 20 may include a handle 52 to facilitate carrying. In one embodiment, the handle 52 is connected to the short wall 34 of the inflatable chamber 24. The handle is advantageously connected to the second short wall portion 35 that includes the valve 48. When the portable salad bar 20 is deflated and rolled from the first short wall portion 34 toward the second short wall portion 35, any excess gas in the inflatable chamber 24 can escape through the valve 48.

The portable salad bar 20 may also include a closure system for holding the portable salad bar 20 in a rolled or folded configuration. One such system is shown in FIGS. 1–4. A strap 66 extends from the second short wall portion 35. A button 68 protrudes from the end of the strap 66. A loop 70 also extends from the second short wall portion 35. When the portable salad bar 20 is rolled or folded into the storage configuration, the portable salad bar 20 can be held in the storage configuration by extending the strap 66 around the portable salad bar 20 and pushing the button 68 through the loop 70.

Other closure systems are well known to those skilled in the art. For example, portions of a hook and a loop material, such as VELCRO®, can be substituted for the button 68 and loop 70 mechanism. Alternatively, a resilient looped lanyard can be connected to the second short wall portion 35 and extended around the portable salad bar 20 to maintain the storage configuration.

When the portable salad bar 20 is needed for use, it can be quickly configured by unfolding or unrolling the salad bar and applying air pressure to the valve to inflate the inflatable chamber 24. In an alternative embodiment, the inflatable chamber 24 may be a self-inflatable structure. The portable salad bar 20 can be self-inflated by way of an automated pump or carbon dioxide cartridge, or other similar methods know to those skilled in the art. After use, the salad bar 20 can be deflated, folded into the storage configuration, and carried away for storage or further use at another location.

While one particular embodiment has been described, it should be understood that the invention is not limited to the particular structure described. For example, the inflatable chamber 24 is not necessarily filled with air, but could alternatively be inflated with an alternate gas or a fluid, such as water.

The foregoing description of the invention has been presented for purposes of illustration and description, and is not intended to be exhaustive or to limit the invention to the precise form disclosed. The description was selected to explain the principles of the invention and their practical application to enable others skilled in the art to best utilize the invention in various embodiments and various modifications as are suited to the particular use contemplated. It is intended that the scope of the invention not be limited by the specification, but defined by the claims set forth below.

The claimed invention is:

1. A portable salad bar comprising:

a flexible base having a non-inflatable generally planar surface;

one or more inflatable chambers connected to the base, wherein the inflatable chambers extend upwardly and have an inner wall and an outer wall, the inner wall and the base defining a reservoir having a flexible bottom surface;

a drain extending through the inflatable chambers;

a filter screen covering the drain; and a valve engaged with the inflatable chambers, wherein the inflatable chambers can be inflated and deflated by way of the valve.

2. The portable salad bar of claim 1, further comprising a handle connected to the inflatable chambers.

3. The portable salad bar of claim 1, further comprising a closure system for securing the portable salad bar in a storage configuration.

4. The portable salad bar of claim 1, wherein the portable salad bar has an inflated serving configuration and a deflated storage configuration, the deflated storage configuration providing a compact package to facilitate storage and transport.

5. The portable salad bar of claim 4, wherein deflation of the inflatable chambers permits the salad bar to be folded or rolled from the inflated serving configuration to the deflated storage configuration.

6. The portable salad bar of claim 1, wherein the drain comprises a tapered drainage duct and a drainage tube extending from the tapered drainage duct through the inflatable chambers to direct fluid away from the salad bar.

* * * * *